US007681932B2

(12) United States Patent
Chang

(10) Patent No.: US 7,681,932 B2
(45) Date of Patent: Mar. 23, 2010

(54) SHOVELING AND THROWING DEVICE

(75) Inventor: Wesley G. Chang, 4847 Vista Ridge Dr., Dublin, OH (US) 43017-5319

(73) Assignee: Wesley G. Chang, Dublin, OH (US)

( * ) Notice: Subject to any disclaimer, the term of this patent is extended or adjusted under 35 U.S.C. 154(b) by 894 days.

(21) Appl. No.: 11/286,556

(22) Filed: Nov. 23, 2005

(65) Prior Publication Data

US 2007/0113430 A1 May 24, 2007

(51) Int. Cl.
*E01H 5/02* (2006.01)

(52) U.S. Cl. ..... 294/54.5; 37/265

(58) Field of Classification Search ..... 294/54.5, 294/55; 37/285, 265

See application file for complete search history.

(56) References Cited

U.S. PATENT DOCUMENTS 3,107,446 A * 10/1963 Messinger ..... 37/434
3,469,326 A 9/1969 Malickson
4,125,951 A 11/1978 Huerth
4,130,953 A 12/1978 Bruno
4,161,073 A 7/1979 Oakes
4,193,626 A 3/1980 Vondracek
4,224,751 A 9/1980 Schoemann et al.
5,018,282 A 5/1991 Hong
5,048,206 A 9/1991 Jones
5,056,245 A 10/1991 Jenkins et al.
5,511,327 A 4/1996 Jurkowski et al.
5,581,915 A 12/1996 Lobato
5,975,602 A * 11/1999 Zan ..... 294/54.5
6,163,986 A 12/2000 Townsend
6,334,640 B1 1/2002 Werner et al.
6,944,907 B2 9/2005 Lynn

* cited by examiner

*Primary Examiner*—Paul T Chin

(57) ABSTRACT

A shoveling and throwing device for moving a snow from a surface comprising a frame having a first and second ends, the frame comprising at least one frame extension extending generally upwardly and at least one wheel disposed on said first end of said frame, a manually operable lever which is pivotally attached proximate to the first end of said frame, a first member having a first end being pivotally attached to the frame extension, a second member having a first end being pivotally attached proximate to a second end of the manually operable lever, a third member having a first end being pivotally attached to a second end of the second member, and a shovel blade pivotally attached to a second end of the third member.

8 Claims, 6 Drawing Sheets

SHOVELING AND THROWING DEVICE

TECHNICAL FIELD OF THE INVENTION

The present invention relates generally to shovels. More particularly, relating to a new and useful shovel for removing material, such as snow, from a surface.

BACKGROUND OF THE INVENTION

The removal of snow from driveways and walkways is normally accomplished in one of two ways. When one wants to avoid manual removal, a wide variety of gasoline powered snow blowers or plows are available. Typically, these blowers and plows come in a variety of widths and horsepower ratings which relate to the rate or amount of snow removal. Disadvantages with such gasoline powered devices include their cost and their lack of maneuverability to work in and around tight places.

For manual removal, a snow shovel is commonly used and its limitations are well known. The shovel can only hold a limited amount of snow and significant back strain results in moving the snow loaded onto the shovel blade to a remote location away from the driveway or walkway. In many instances the snow must be moved several feet depending upon the length and width of the driveway or walkway. Furthermore, for many people the act of shoveling their driveway or walkway is a physically exhausting task.

The present invention reduces the effort that one must exert in order to clear their driveway or walkway of snow. In view of the present disclosure or through practice of the present invention, other advantages may become apparent.

SUMMARY OF THE INVENTION

In general terms, the present invention includes a shoveling and throwing device comprising: (a) a frame having a first and second ends, the frame comprising at least one frame extension extending generally upwardly and disposed between the first end and the second end, and at least one wheel extension extending generally downwardly and disposed between the first end and the second end, each wheel extension having a terminal end provided with at least one wheel, the first end of the frame comprising a scraper capable of scooping a material from a surface, the second end of the frame comprising a handle; (b) a shovel blade, the shovel blade proximate to the scraper in a first position so as to receive material scooped from the surface by the scraper; (c) a manually operable lever having a first end pivotally attached to the frame between the wheel extension and the first end, the manually operable lever having a second end which when depressed causes the shovel blade to elevate to a second position so as to empty the material accumulated on the shovel blade and when released returns the shovel blade to the first position; (d) a first member pivotally attached to the shovel blade at a first end and pivotally attached to the frame extension; (e) a second member pivotally attached to the manually operable lever at a first end, the second member having a second end; and (f) a third member pivotally attached to the second end of the second member at a first end and to the shovel blade at a second end.

DETAILED DESCRIPTION OF THE PREFERRED EMBODIMENT(S)

In accordance with the foregoing summary of the invention, the following presents a detailed description of the preferred embodiment of the invention which is presently considered to be its best mode.

Figure 1:
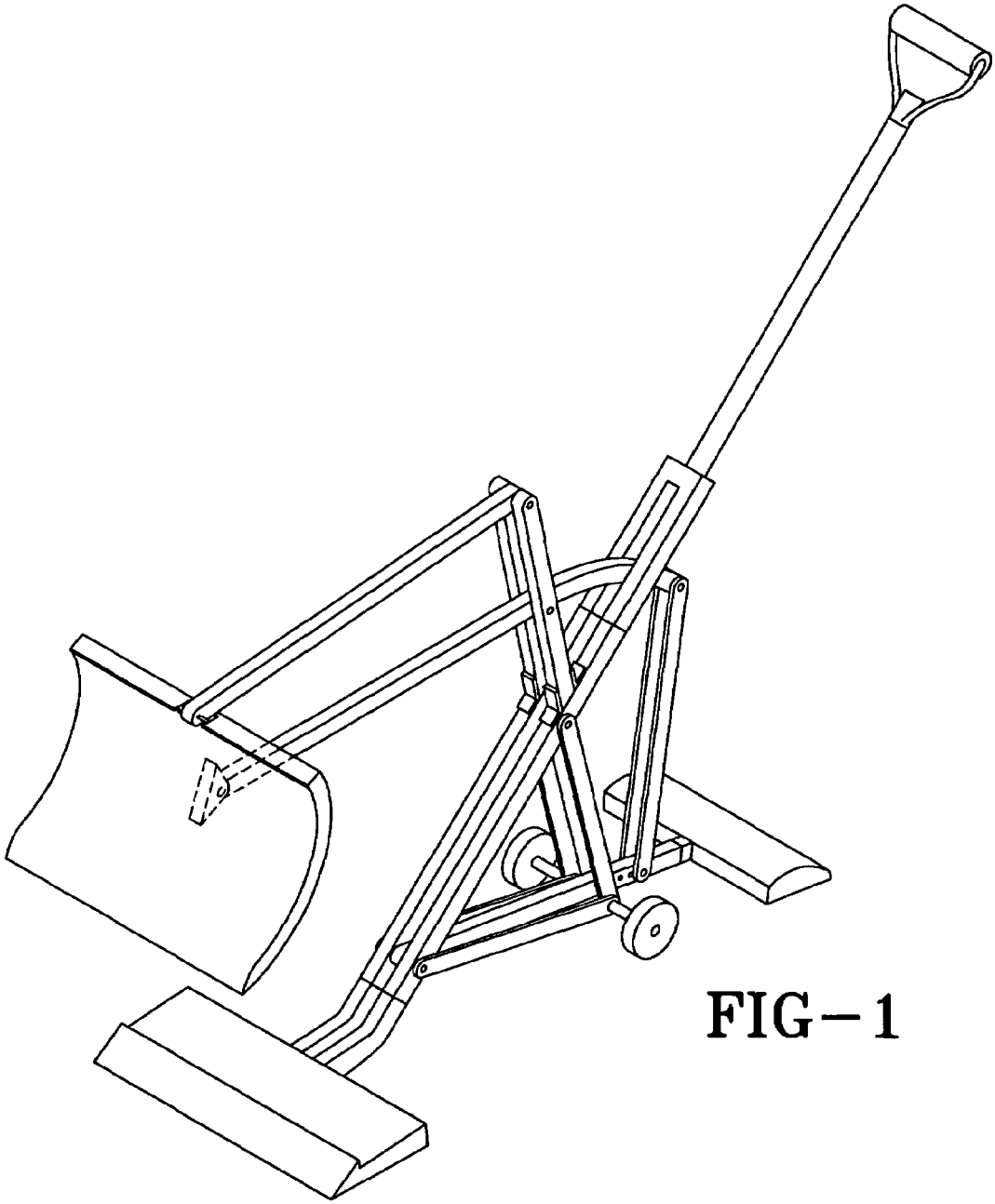
FIG. 1 depicts an isometric view of one embodiment of the present invention.
Figure 1A:
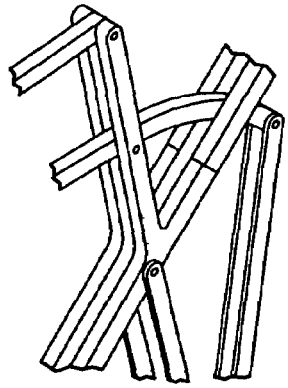
FIG. 1*a* depicts an alternative embodiment of the frame extensions of one embodiment of the present invention.

FIG. 1 presents an isometric view of one embodiment of the present invention. FIG. 1*a* is a close up of a variation of frame extension that may be used in practicing the present invention.

Figure 2:
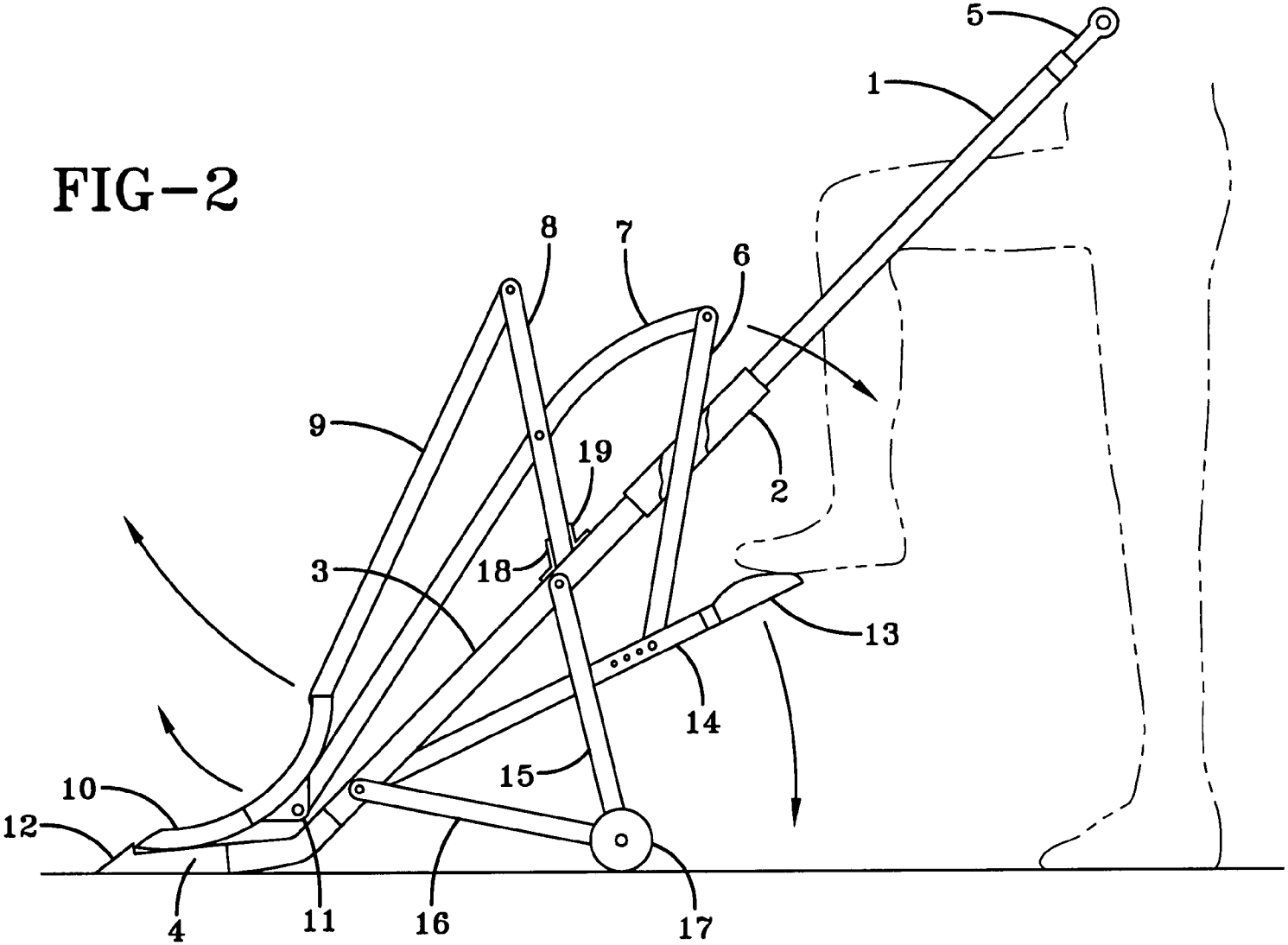
FIG. 2 depicts a side view of one embodiment of the present invention when scooping a material from a surface.

FIG. 2 presents a side view of one embodiment of the present invention. As shown in FIG. 2, upper frame 1 has a first end 3 having a scraper extension 4 disposed thereon and a second end having a handle 5. The scraper extension 4 has a scraper 12 and a rear lip. Frame extension 8 extends upwardly from lower frame 3. As shown in FIG. 2, frame extension 8 is a separate piece that is mounted onto lower frame 3 by brackets 18 and 19. Alternatively, the frame extension(s) may be a portion of the lower frame itself. That is to say, the geometry of the frame would eliminate the need for a separate piece to be bolted thereto. Extending downwardly from lower frame 3, wheel extensions 15 and 16 terminate in wheel assembly 17. Alternatively, the wheel extension(s) may be a portion of the lower frame rather than separate pieces affixed thereto.

Shovel blade 10 is positioned behind the rear lip of the scraper extension 4 so as to receive any material such as snow scooped from the surface of a driveway or walkway. A first member 9 is pivotally attached near the top edge of the shovel blade 10 on one end and is pivotally attached to frame extension 8 on the other.

Manually operable lever 14 has a first end pivotally attached to the lower frame 3 between wheel extension 15 and scraper extension 4. The second end of the manually operable lever 14 is provided with a pedal 13 on which a user may exert a downward force. Between the first end of manually operable lever 14 and the pedal, the first end of second member 6 is pivotally attached. Alternatively, second member 6 may be a spring which is connected on one end to manually operable lever 14 and on its other end to third member 7. In those embodiments where second member 6 is a spring, a spring having a sufficient modulus of resilience should be selected so as to enable non-linear acceleration of the shovel towards its fully extended position (see FIG. 3). Second member 6 extends through an opening in the frame connector 2. The attachment of the manually operable lever 14 and second member 6 may be adjustable so as to permit the user to vary the attachment point and correspondingly vary the amount of effort required to raise the shovel blade with a commensurate change in the maximum height to which the shovel blade can be raised. Second member 6 is also pivotally attached to third member 7. The attachment point of the second and third member may be similarly adjustable. Third member 7 is pivotally attached 11 to the rear of shovel blade 10.

When the user has advanced the shovel and throwing device of the present invention as far forward as desired, or capable, the user depresses the pedal 13 to cause manually operable lever 4 to impart a downward force on second member 6 (optionally, second member 6 may be a spring) thereby rotating third member 7 about a pivotal attachment point with frame extension 8. Correspondingly, shovel blade 10 rises from its first position a distance related to the depression of the pedal.

Although a wide variety of materials may be used to construct a shovel and throwing device according to the present invention, the following table details the preferred material for each component.

| Component Name | Material |
|---|---|
| Upper frame | Aluminum (A6063-T5) |
| Frame connector | Thermoplastic (Verton PDX P-00700) |
| Lower frame | Glass-filled Polypropylene |
| Scraper extension | Glass-filled Polypropylene |
| Handle | Polypropylene |
| First member | AISI 301 or Equiv. |
| Second member | AISI 301 or Equiv. |
| Third member | Aluminum (A6063-T5) or Thermoplastic (Verton PDX P-00700) |
| Frame extension | AISI 301 or Equiv. |
| Shovel | Aluminum (A6063-T5) |
| Shovel bracket | SAPH 440 or equiv. |
| Scraper | AISI 1025 or equiv. |
| Foot pedal | TPO or Equiv. |
| Manually operable lever | AISI 301 or Equiv. |
| Wheel extensions | AISI 301 or Equiv. |
| Wheel assembly | SP/SBR |
| Bracket | SAPH 440 or equiv. |

Figure 3:
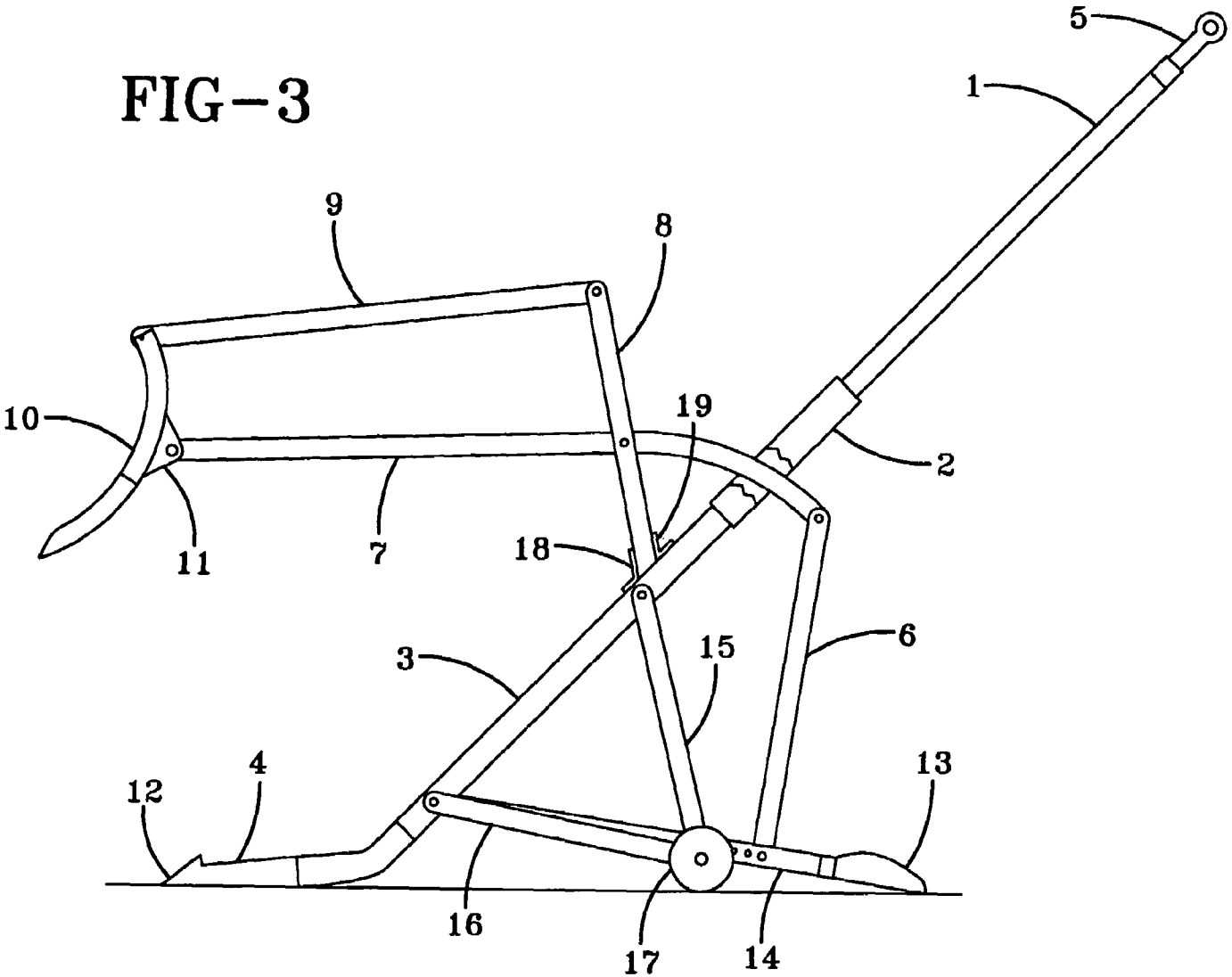
FIG. 3 depicts a side view of one embodiment of the present invention when emptying the shovel blade.

FIG. 3 illustrates the shovel and throwing device of the present invention when the pedal is fully depressed (i.e., pressed to the ground).

Figure 4:
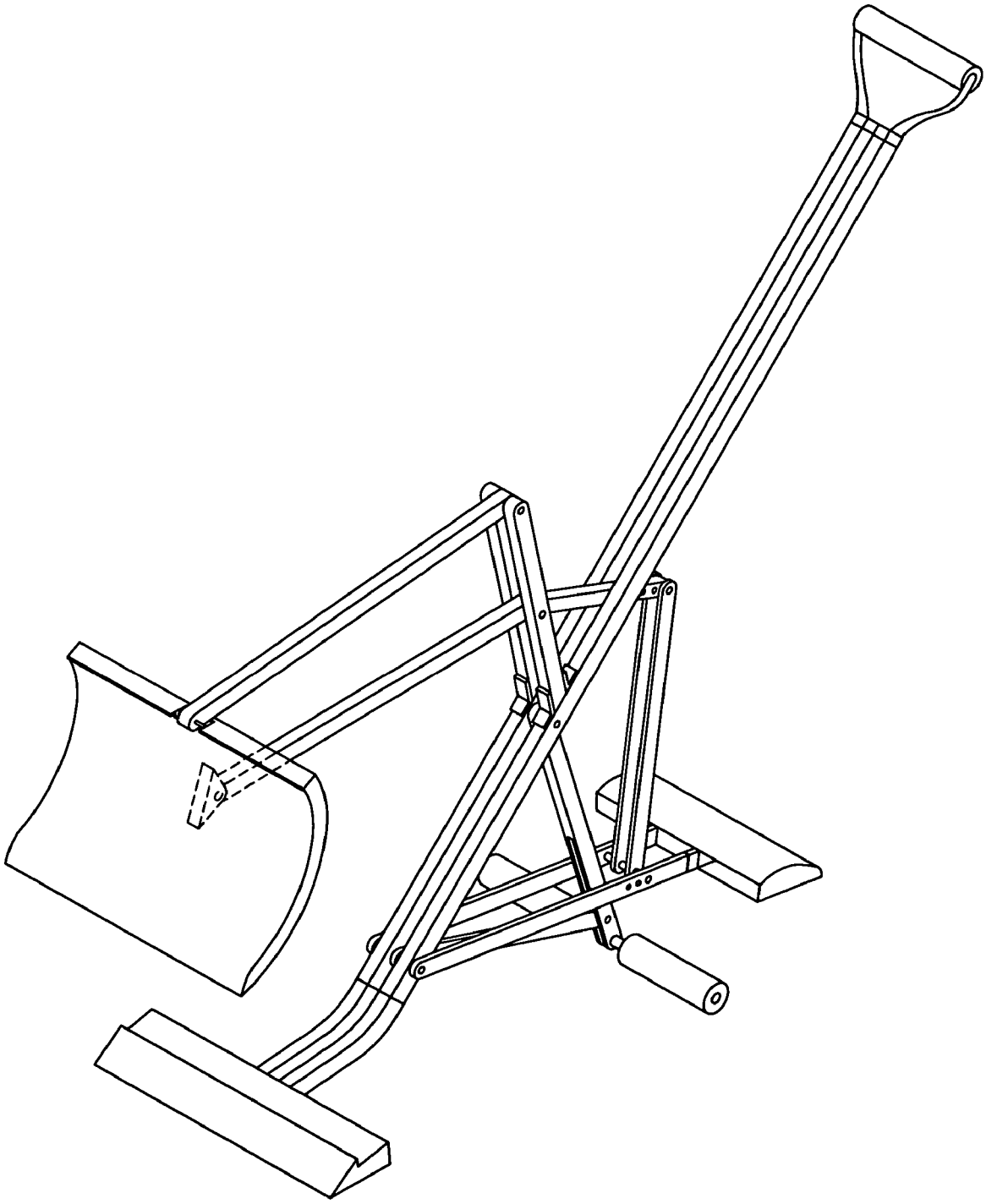
FIG. 4 is an isometric view of a second embodiment of the present invention.

FIG. 4 presents a second embodiment of the present invention showing an alternative frame design and wheel extension design.

Figure 5:
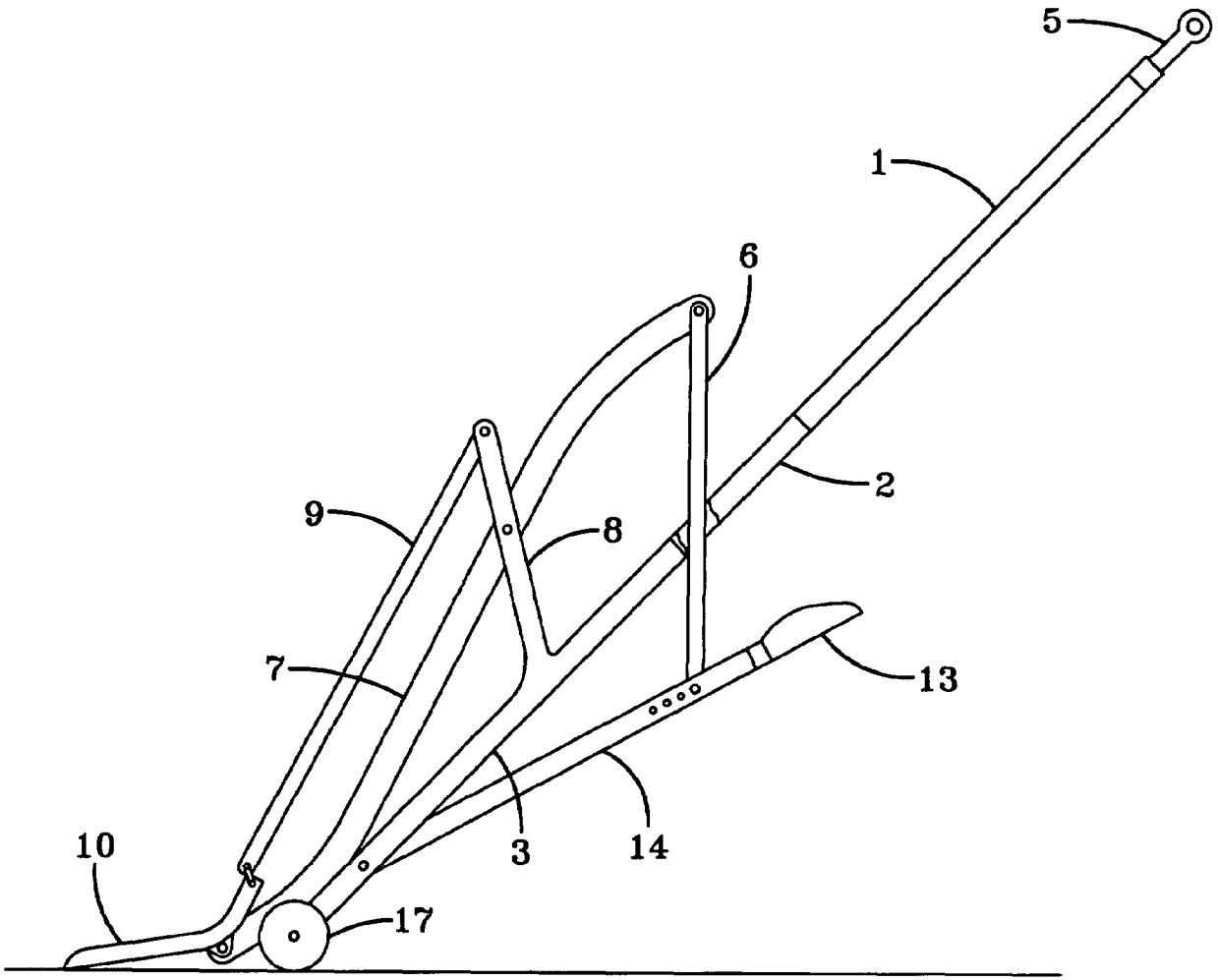
FIG. 5 illustrates an alternative embodiment of the present invention wherein the scraper and its extension have been replaced with a wheel assembly.

As shown in the alternative embodiment of FIG. 5, upper frame 1 is connected to a first end of frame connector 2, which is itself connected to lower frame 3. A wheel assembly 17 is disposed on the terminal end of lower frame 3. Frame extension 8 extends upwardly from lower frame 3. As shown in FIG. 5, frame extension 8 is an integral part of lower frame 3; alternatively, frame extension 8 may be a separate piece that is mounted onto lower frame 3.

A first member 9 is pivotally attached near the top edge of the shovel blade 10 on one end and is pivotally attached to frame extension 8 on the other.

Manually operable lever 14 has a first end pivotally attached to lower frame 3. The second end of manually operable lever 14 is provided with a pedal 13 on which a user exerts a downward force to actuate the device.

Between the first end and the pedal, manually operable lever 14 is pivotally attached to the first end of second member 6 which extends through an opening in frame connector 2. The attachment of the manually operable lever 14 and second member 6 may be adjustable so as to permit the user to vary the attachment point and correspondingly vary the amount of effort required to raise the shovel blade with a commensurate change in the maximum height to which the shovel blade can be raised. Second member 6 is also pivotally attached to third member 7. Third member 7 is pivotally attached to the rear of shovel blade 10.

When the user has advanced the shovel and throwing device of the present invention as far forward as desired, or capable, the user depresses the pedal 13 to cause manually operable lever 14 to impart a downward force on second member 6 thereby rotating third member 7 about its pivotal attachment with frame extension 8. Correspondingly, shovel blade 10 rises from its first position a distance related to the depression of the pedal.

Figure 6:
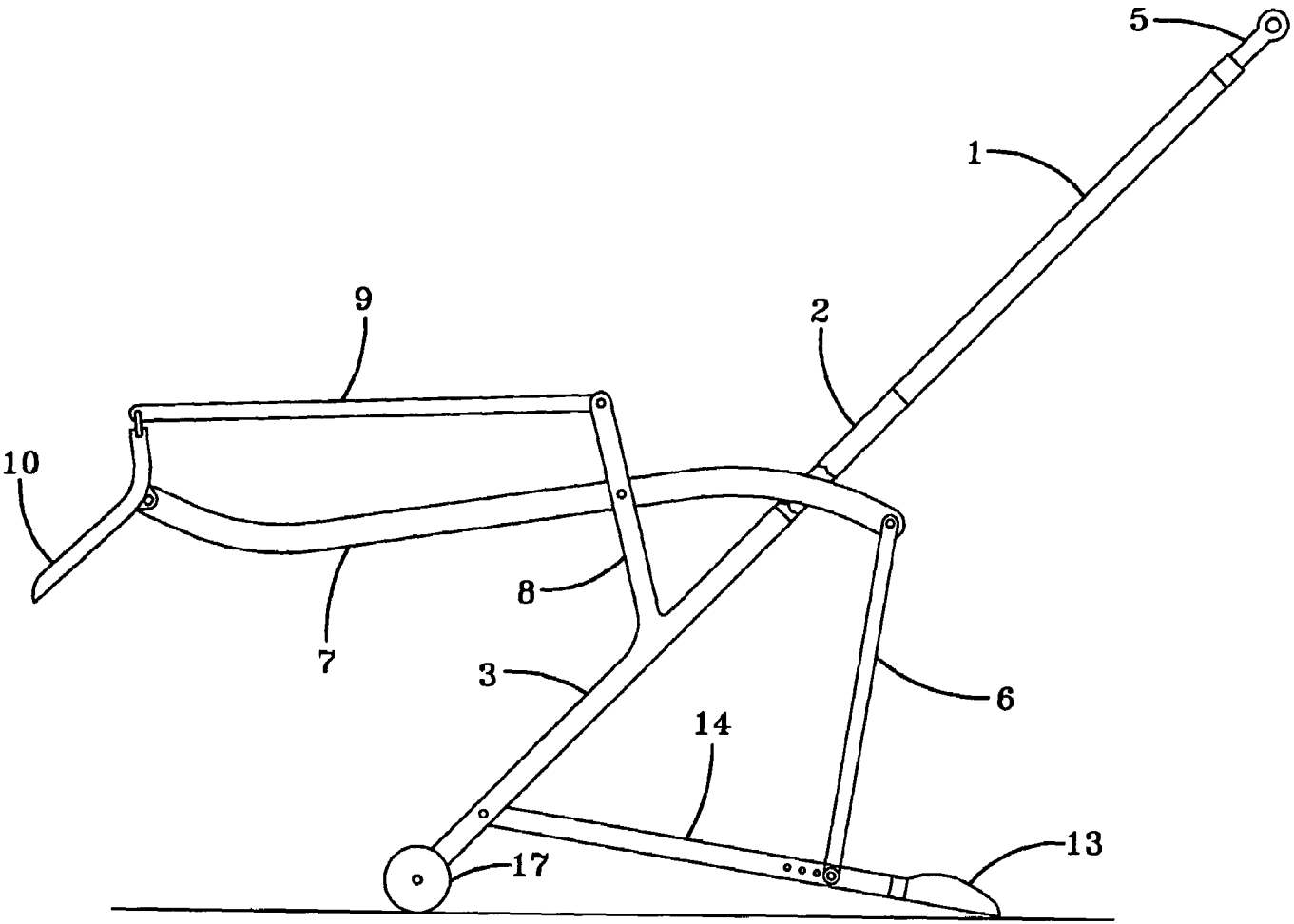
FIG. 6 depicts the alternative embodiment of FIG. 5 when emptying the shovel blade.

FIG. 6 illustrates the shovel and throwing device of the present invention when the pedal is fully depressed (i.e., pressed to the ground).

In view of the present disclosure or through practice of the present invention, it will be within the ability of one of ordinary skill to make modifications to the present invention, such as through the use of equivalent arrangements and compositions, in order to practice the invention without departing from the spirit of the invention as reflected in the appended claims.

What is claimed is:

1. The shoveling and throwing device comprising:

(a) a frame having a first and second ends and an opening disposed there between, said frame comprising at least one frame extension extending generally upwardly and disposed between said first end and said opening, and at least one wheel disposed on said first end of said frame, said second end of said frame comprising a handle;

(b) a manually operable lever having a first end which is pivotally attached proximate to said first end of said frame, said manually operable lever having a second end;

(c) a first member having a first and second end, said first end of said first member pivotally attached to said frame extension;

(d) a second member having a first and second end, said first end of said second member pivotally attached proximate to said second end of said manually operable lever, said second member extending upwardly through said opening in said frame;

(e) a third member having a first and second end, said first end of said third member pivotally attached to said second end of said second member; and (f) a shovel blade pivotally attached to said second end of said third member, said shovel blade additionally pivotally attached to second end of said first member, wherein depressing said manually operable lever causes said shovel blade to elevate to a second position so as to empty material accumulated on said shovel blade and when released returns said shovel blade to said first position.

2. The shoveling and throwing device according to claim 1 additionally comprising a pedal disposed on said second end of said manually operable lever.

3. The shoveling and throwing device according to claim 1 wherein said handle is padded.

4. The shoveling and throwing device according to claim 3 wherein said handle is padded with foam.

5. The shoveling and throwing device according to claim 1 wherein said second member is a spring.

6. The shoveling and throwing device according to claim 1 wherein the position of said pivotal attachment of said second member to said manually operable lever is adjustable along said first end of said manually operable lever.

7. The shoveling and throwing device according to claim 1 wherein the position of said pivotal attachment of said second member to said third member is adjustable along said first end of said third member.

8. The shoveling and throwing device according to claim 1 wherein the position of said pivotal attachment of said first member to said frame extension is adjustable along a first end.

* * * * *